US008056449B2

(12) United States Patent
Hsieh

(10) Patent No.: US 8,056,449 B2
(45) Date of Patent: Nov. 15, 2011

(54) WRENCHING TOOL APPLICABLE TO VARIOUS SIZES OF THREADED MEMBERS

(76) Inventor: Chih-Ching Hsieh, Taichung Hsien (TW)

( * ) Notice: Subject to any disclaimer, the term of this patent is extended or adjusted under 35 U.S.C. 154(b) by 203 days.

(21) Appl. No.: 12/502,338

(22) Filed: Jul. 14, 2009

(65) Prior Publication Data

US 2011/0011218 A1 Jan. 20, 2011

(51) Int. Cl.
*B25B 13/02* (2006.01)
*B25B 13/48* (2006.01)

(52) U.S. Cl. ..... 81/121.1; 81/124.4

(58) Field of Classification Search ..... 081/121.1, 081/119, 124.4, 124.6, 124.3, 18
See application file for complete search history.

(56) References Cited

U.S. PATENT DOCUMENTS

| | | | | | |
|---|---|---|---|---|---|
| 4,100,824 | A * | 7/1978 | Marschke | ..... | 81/124.6 |
| 4,646,594 | A * | 3/1987 | Tien | ..... | 81/121.1 |
| 5,388,486 | A * | 2/1995 | Ruzicka et al. | ..... | 81/121.1 |
| 5,595,096 | A * | 1/1997 | Coffman | ..... | 81/121.1 |
| 5,832,792 | A * | 11/1998 | Hsieh | ..... | 81/124.6 |
| D524,615 | S * | 7/2006 | Albertson | ..... | D8/29 |

* cited by examiner

*Primary Examiner* — Hadi Shakeri
(74) *Attorney, Agent, or Firm* — Guice Patents PLLC

(57) ABSTRACT

The present invention provides a wrenching tool having a polygonal fitting hole formed of a first equilateral polygonal hole and a second equilateral polygonal hole with the same configuration. The two polygonal holes are concentrically arranged to provide two fitting positions for fitting to threaded members. The first polygonal hole has multiple first internal angles each having two sides. A first small internal angle is further disposed on one side of each first internal angle of at least the first polygonal hole. The first small internal angles provide another fitting position for fitting to another size of threaded member. Accordingly, the wrenching tool is applicable to various sizes of threaded members.

21 Claims, 11 Drawing Sheets

WRENCHING TOOL APPLICABLE TO VARIOUS SIZES OF THREADED MEMBERS

BACKGROUND OF THE INVENTION

The present invention is related to a hand tool, and more particularly to a wrenching tool, which is applicable to various sizes of threaded members for wrenching the same.

FIELD OF THE INVENTION

A socket is a common hand tool used to wrench a threaded member. The socket has a polygonal fitting hole, whereby the socket can be fitted onto the threaded member to wrench the same.

FIG. 1 shows a conventional socket 10 having a fitting hole 12. The fitting hole 12 is composed of two concentric hexagonal holes. Accordingly, the fitting hole 12 has twelve internal angles. A first hexagonal hole has six internal angles 14, while a second hexagonal hole has six other internal angles 16. The first hexagonal hole with the first group of internal angles 14 has a larger size for wrenching a larger threaded member. The second hexagonal hole with the second group of internal angles 16 has a smaller size for wrenching a smaller threaded member. Accordingly, the socket 10 is applicable to two sizes of threaded members.

The above socket 10 has two fitting positions for different sizes of threaded members, however, the application range of such socket 10 is still quite limited.

SUMMARY OF THE INVENTION

It is therefore a primary object of the present invention to provide a wrenching tool, which is applicable to various sizes of threaded members to enhance utility efficiency.

It is a further object of the present invention to provide the above wrenching tool, which provides at least three fitting positions for fitting to different sizes of threaded members.

The wrenching tool of the present invention has a polygonal fitting hole formed of a first equilateral polygonal hole and a second equilateral polygonal hole with the same configuration. The two polygonal holes are concentrically arranged with an angular displacement to provide two fitting positions. The first polygonal hole has multiple first internal angles each having two sides. A first small internal angle is disposed on one side of each first internal angle of the first polygonal hole. The first small internal angles provide another fitting position for fitting to another size of threaded member.

The wrenching tool provides other fitting positions in addition to the original fitting positions. Therefore, the wrenching tool has at least three fitting positions for operating more different sizes of threaded members.

Preferably, a second small internal angle is disposed on the other side of each first internal angle of the first polygonal hole. The second small internal angles provide still another fitting position for threaded member.

Preferably, a third small internal angle is disposed on one side of each second internal angle of the second polygonal hole. The third small internal angles provide still another fitting position for threaded member.

Preferably, a fourth small internal angle is disposed on the other side of each second internal angle of the second polygonal hole. The fourth small internal angles provide still another fitting position for threaded member.

The present invention can be best understood through the following description and accompanying drawings wherein:

DETAILED DESCRIPTION OF THE PREFERRED EMBODIMENTS

Figure 1:
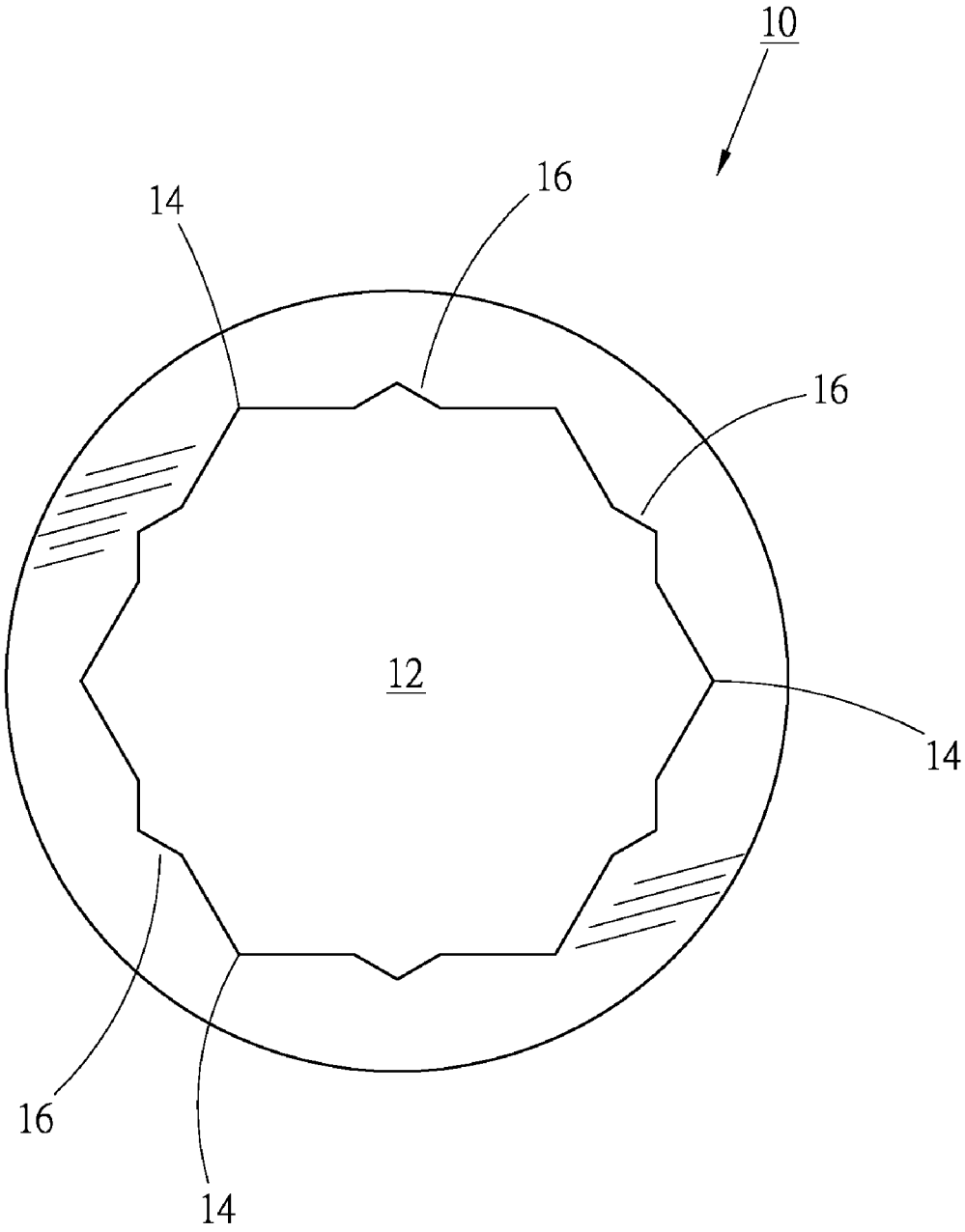
Fig. 1 PRIOR ART
FIG. 1 is an end view of a conventional socket.
Figure 2:
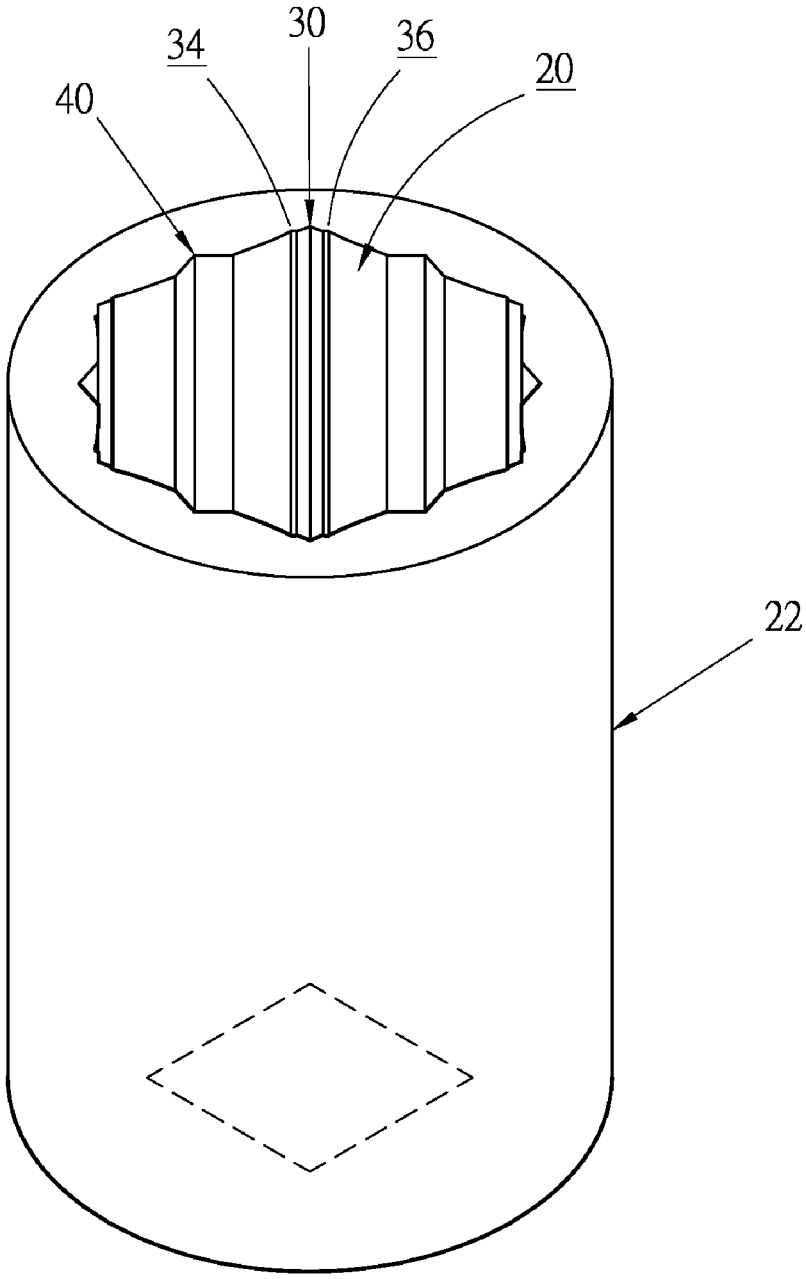
FIG. 2 is a perspective view showing that the present invention is an application of a socket.
Figure 3:
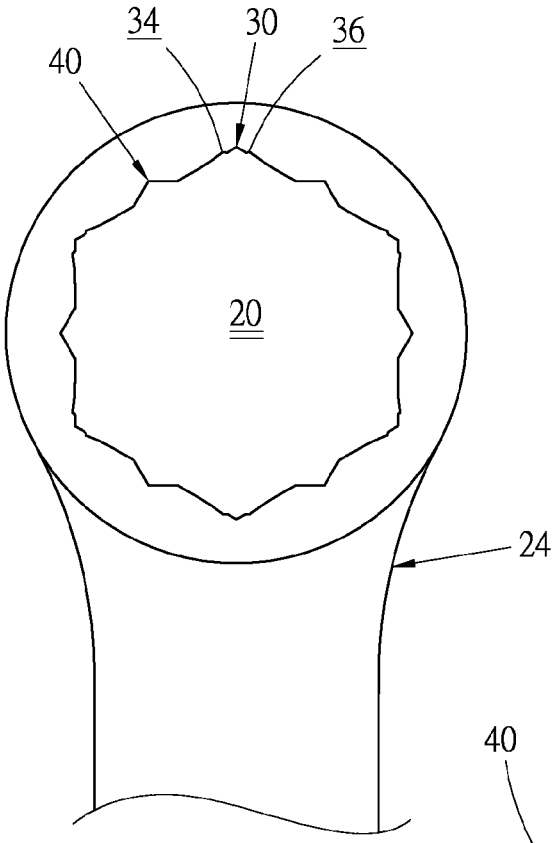
FIG. 3 is a top view showing that the present invention is an application of a box end wrench.
Figure 4:
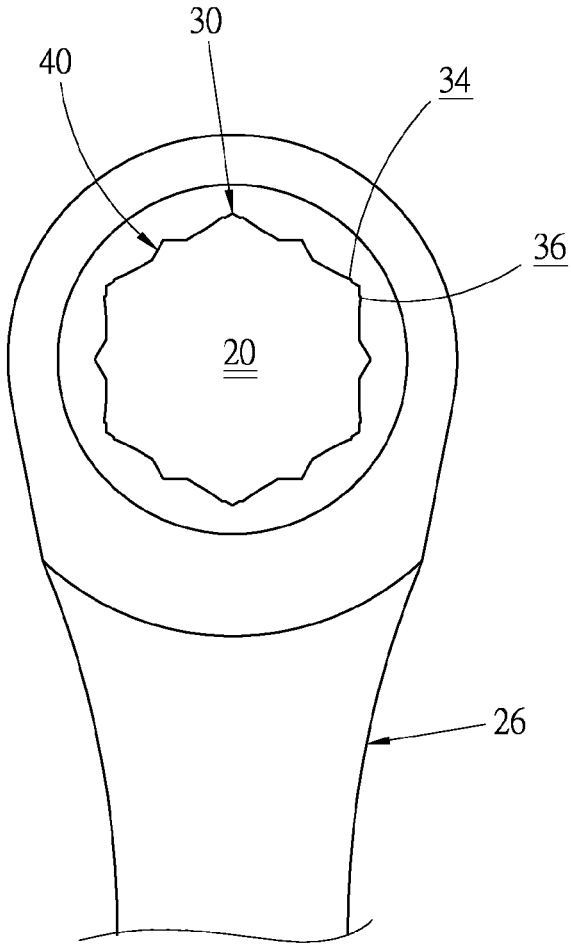
FIG. 4 is a top view showing that the present invention is an application of a ratchet wrench.

The wrenching tool of the present invention has a fitting hole and is applicable to various threaded members for wrenching the same. The wrenching tool with the fitting hole 20 can be a socket 22 as shown in FIG. 2 or a box end wrench 24 as shown in FIG. 3 or a ratchet wrench 26 as shown in FIG. 4. In other words, the wrenching tool of the present invention can be any type of wrenching tool for wrenching threaded members.

Figure 5:
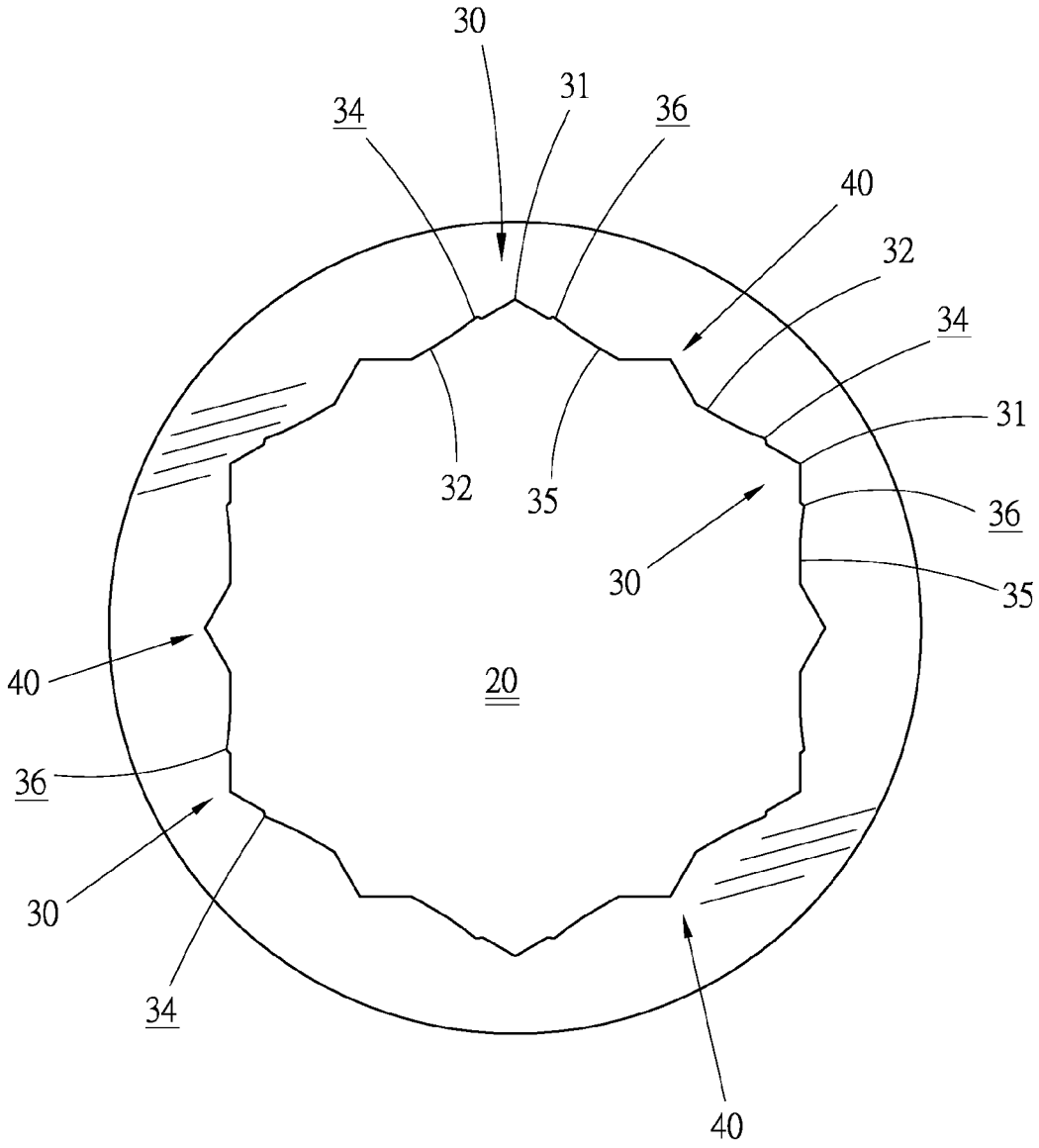
FIG. 5 is a top view of a first embodiment of the present invention.

FIG. 5 is an end view showing the fitting hole 20 of the present invention according to a first embodiment thereof. The fitting hole 20 basically is formed of two polygonal holes with the same configuration but different sizes. For example, the polygonal holes can be equilateral triangular holes, equilateral quadrangular holes, equilateral pentagonal holes or the like. In this embodiment, the polygonal holes are equilateral hexagonal holes. The hexagonal holes are concentrically arranged with an angular displacement. That is, the six internal angles 30 of the first hexagonal hole and the six internal angles 40 of the second hexagonal hole are alternately arranged so that the fitting hole 20 has twelve internal angles on its wall.

For facilitating illustration, the internal angles 30 of the first hexagonal hole are defined as first internal angles, while the internal angles 40 of the second hexagonal hole are defined as second internal angles. The size of the first hexagonal internal angles is larger than the size of the second hexagonal internal angles. Therefore, the fitting hole 20 is applicable to different sizes of threaded members.

Figure 6:
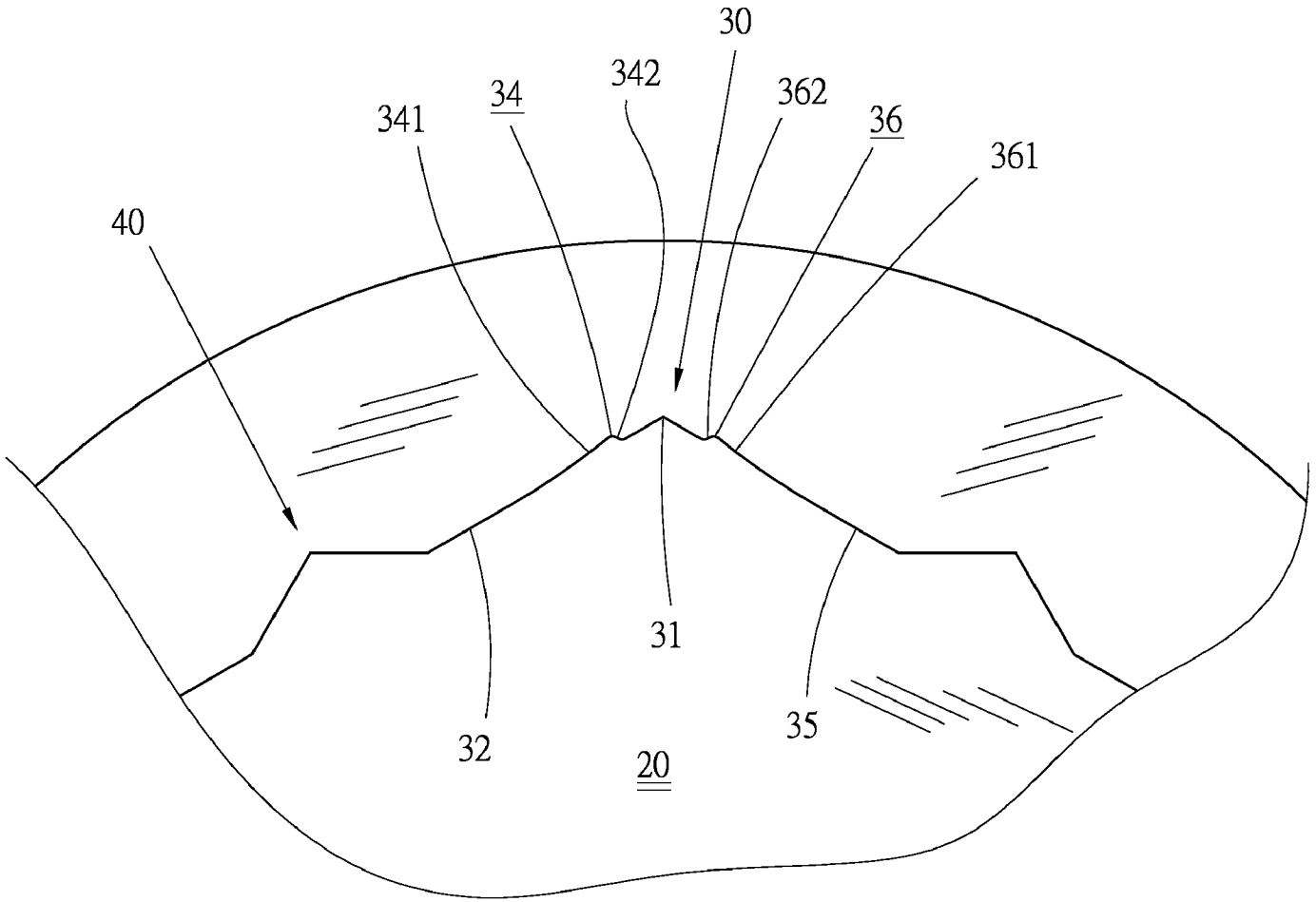
FIG. 6 is an enlarged view of a part of FIG. 5.

Each first internal angle 30 has two sides 32, 35. The first side 32 such as the left side of the first internal angle 30 is formed with a first small internal angle 34. The six first small internal angles 34 together form a configuration of a third hexagon. Referring to FIG. 6, each first small internal angle 34 has a first small side 341 and a second small side 342. The lengths of the first and second small sides are unequal to each other. The first small side 341 is a long side, which is a slope or an arced side, and is farther from the tip 31 of the internal angle 30. The second small side 342 is a short side and is nearer from the tip 31 of the internal angle 30.

Similarly, the second side 35 such as the right side of the first internal angle 30 is formed with a second small internal angle 36. Referring to FIG. 6, each second small internal angle 36 has a third small side 361 and a fourth small side 362. The lengths of the third and fourth small sides are unequal to each other. The third small side 361 is a long side, which is a slope or an arced side, and is farther from the tip 31 of the internal angle 30 than the fourth small side is. The fourth small side 362 is a short side and is nearer from the tip 31 of the internal angle 30. The six second small internal angles 36 together form a configuration of a fourth hexagon.

Figure 7:
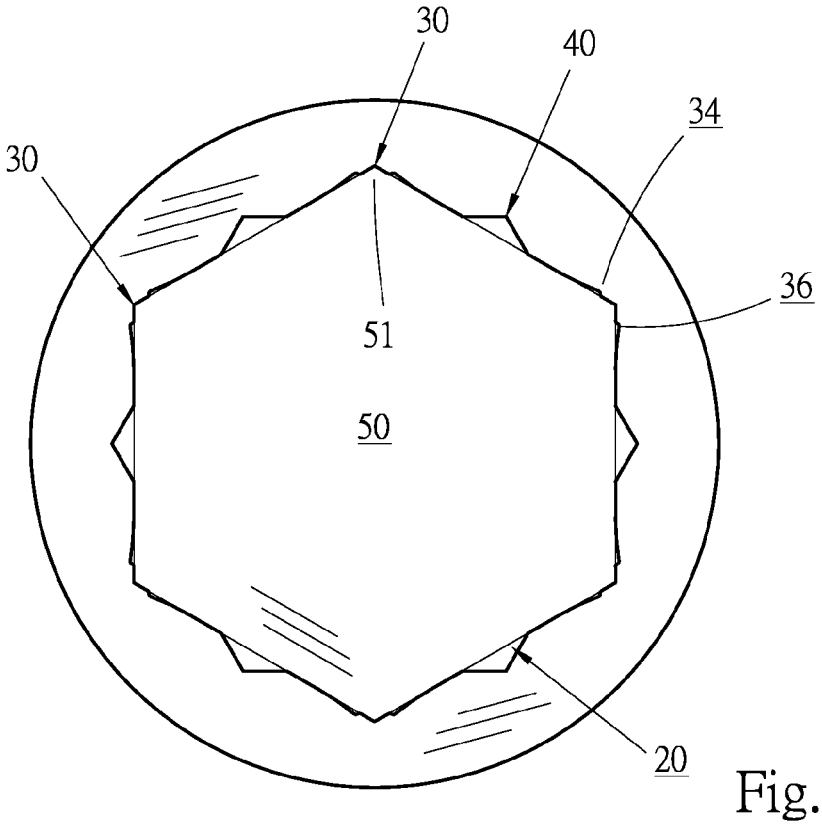
FIG. 7 shows that a threaded member is fitted in a first group of internal angles of the present invention.
Figure 8:
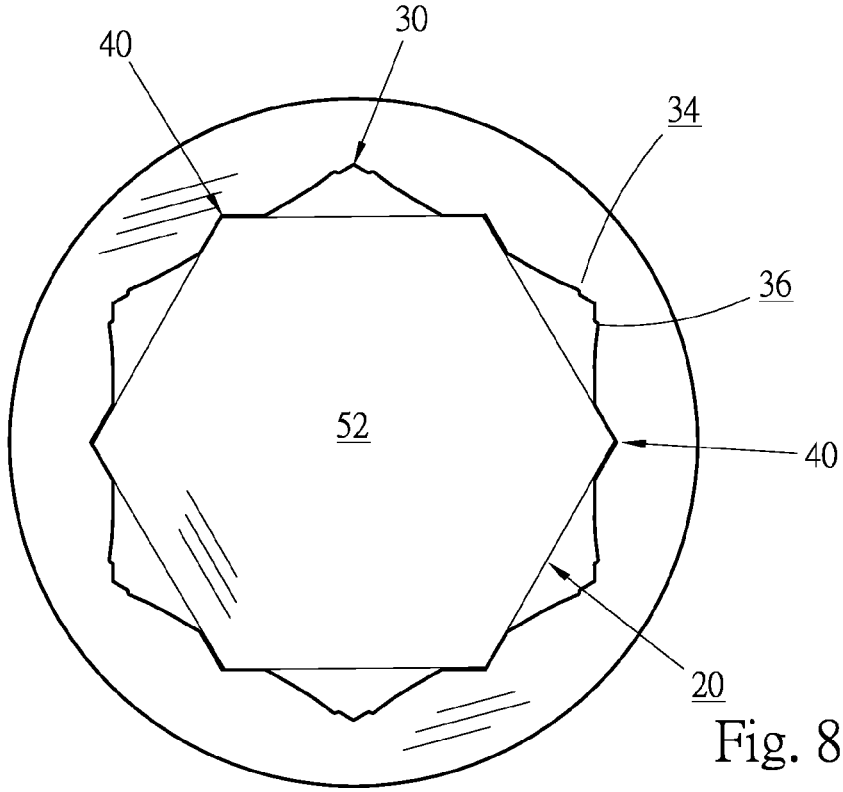
FIG. 8 shows that another threaded member is fitted in a second group of internal angles of the present invention.
Figure 9:
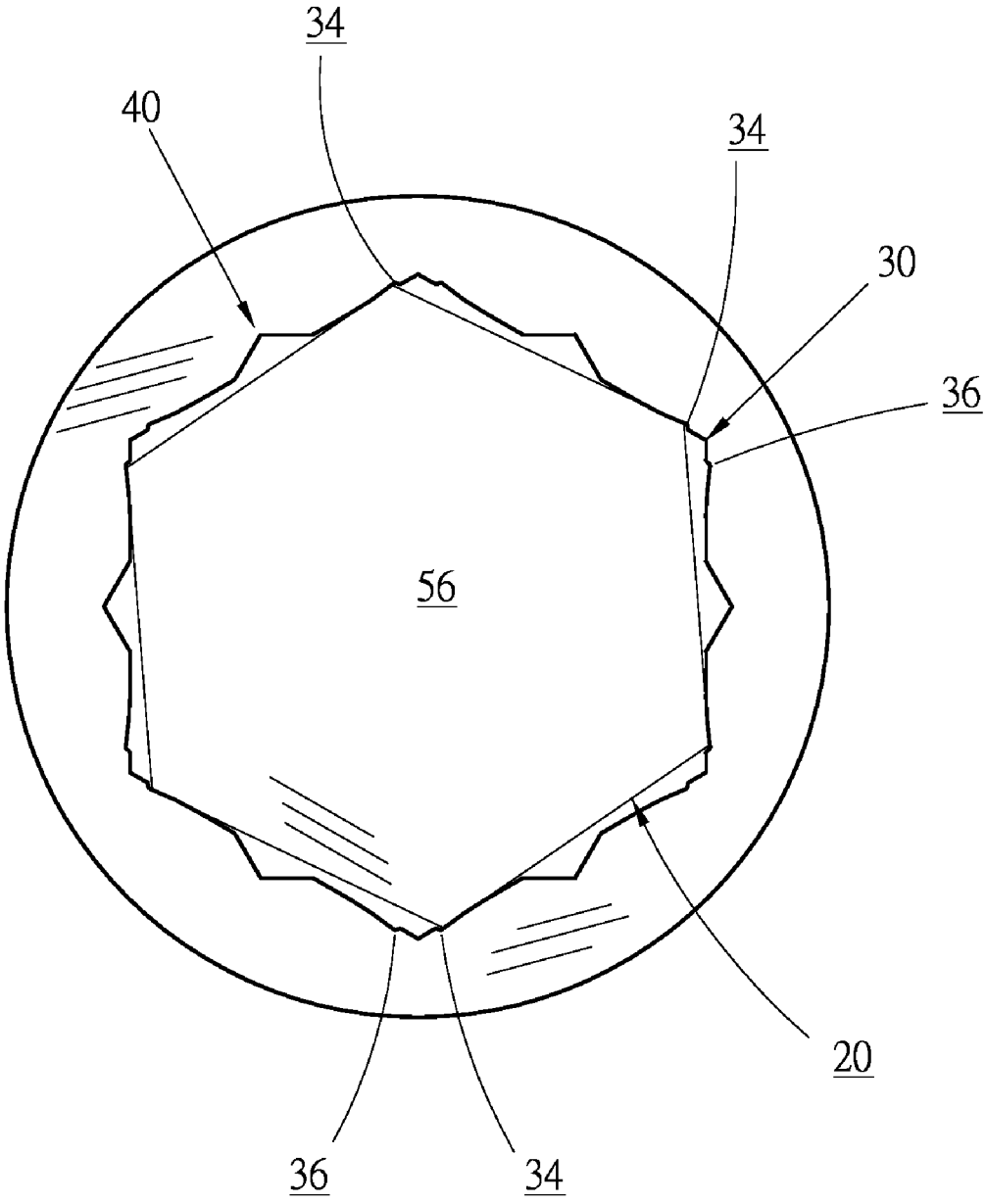
FIG. 9 shows that another threaded member is fitted in a group of small internal angles of the present invention.
Figure 10:
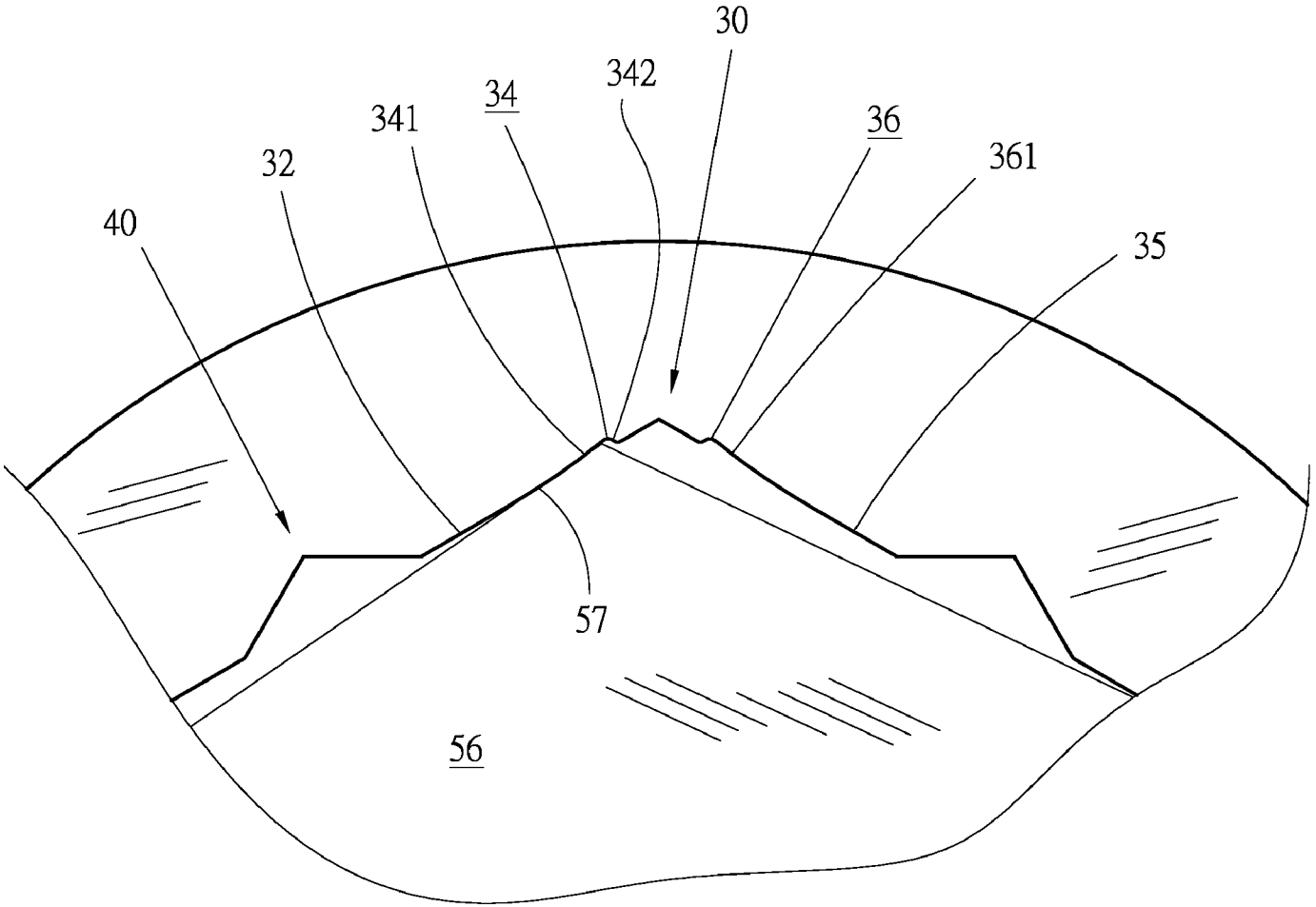
FIG. 10 is an enlarged view of a part of FIG. 9.

The present invention can be used to wrench various sizes of threaded members. Referring to FIG. 7, the internal angles 30 of the first hexagonal hole of the fitting hole 20 provide a first fitting position for fitting to a larger size of threaded member 50. For example, the angles of a metric system 18 mm threaded member can be accommodated in the internal angles 30. The internal angles 40 of the second hexagonal hole provide a second fitting position for fitting to a smaller size of threaded member 52, for example, a metric system 17 mm threaded member as shown in FIG. 8. In addition, the six first small internal angles 34 provide a third fitting position for fitting to a third size of threaded member 56 as shown in FIGS. 9 and 10, for example, a British system 11/16 inch threaded member. The long side 341 of the small internal angle 34 can well contact a side 57 of the threaded member 56 well. Similarly, the six second small internal angles 36 provide a fourth fitting position for fitting to another threaded member. The long side 361 of the small internal angle 36 can contact the threaded member well. Accordingly, the fitting hole 20 is applicable to at least three different sizes of threaded members.

In the above embodiment, the first and second hexagonal holes have metric system dimensions, while the fitting position provided by the first small internal angles has British system dimension. It should noted that in practice, the first and second hexagonal holes can alternatively have British system dimensions, for example, ¾ inch and 11/16 inch, while the fitting position provided by the first small internal angles has metric system dimension such as 18 mm.

Figure 11:
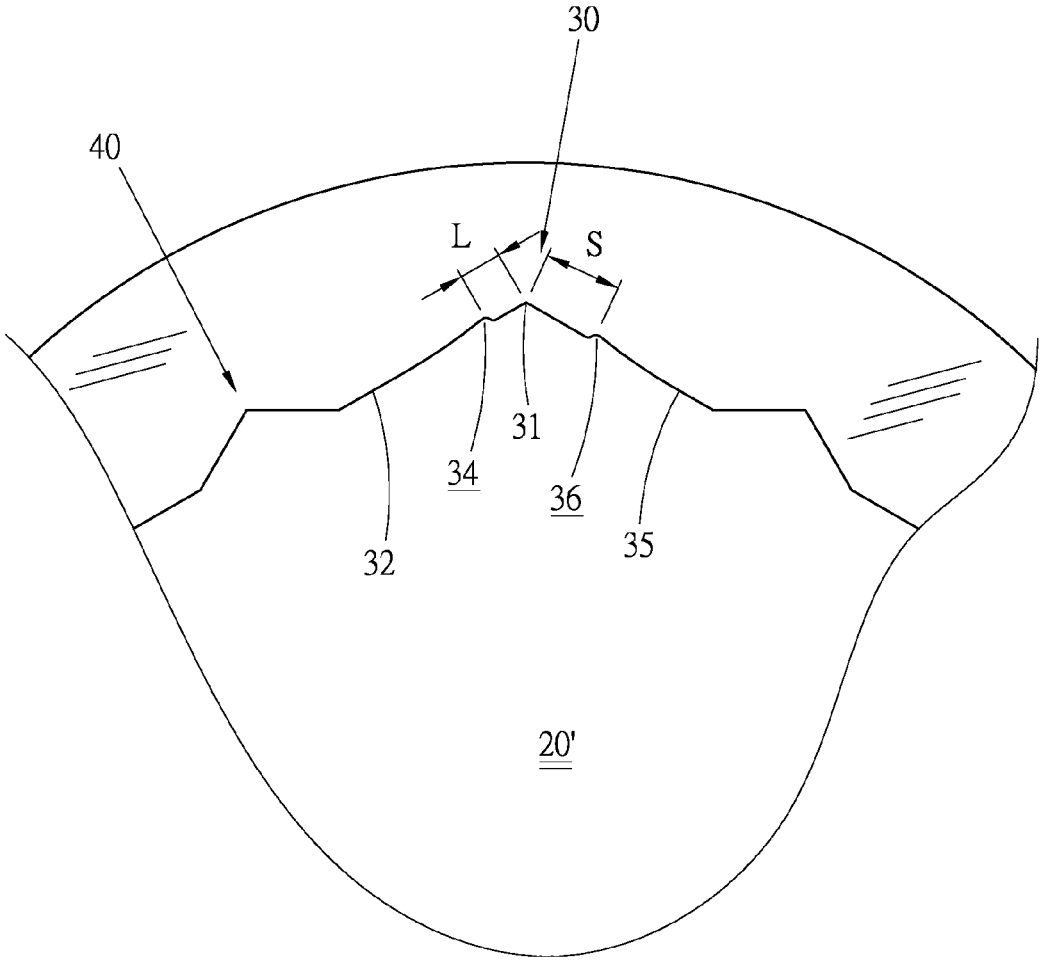
FIG. 11 is an enlarged view of a part of a second embodiment of the present invention.

FIG. 11 shows a second embodiment of the wrenching tool of the present invention, in which the same components are denoted with the same reference numbers. In this embodiment, the first hexagonal hole of the fitting hole 20' has six first internal angles 30 each having two sides 32, 35. The two sides 32, 35 are respectively formed with a first small internal angle 34 and a second small internal angle 36. The two small internal angles 34, 36 are respectively spaced from the tip 31 of the internal angle 30 by a distance L and a distance S. The distances L and S are unequal to each other. Accordingly, the six first small internal angles 34 and the six second small internal angles 36 provide different sizes of fitting positions. The first group of small internal angles 34 can be fitted to a third size of threaded member, while the second group of small internal angles 36 can be fitted to a fourth size of threaded member, which size can be metric system or British system.

Figure 12:
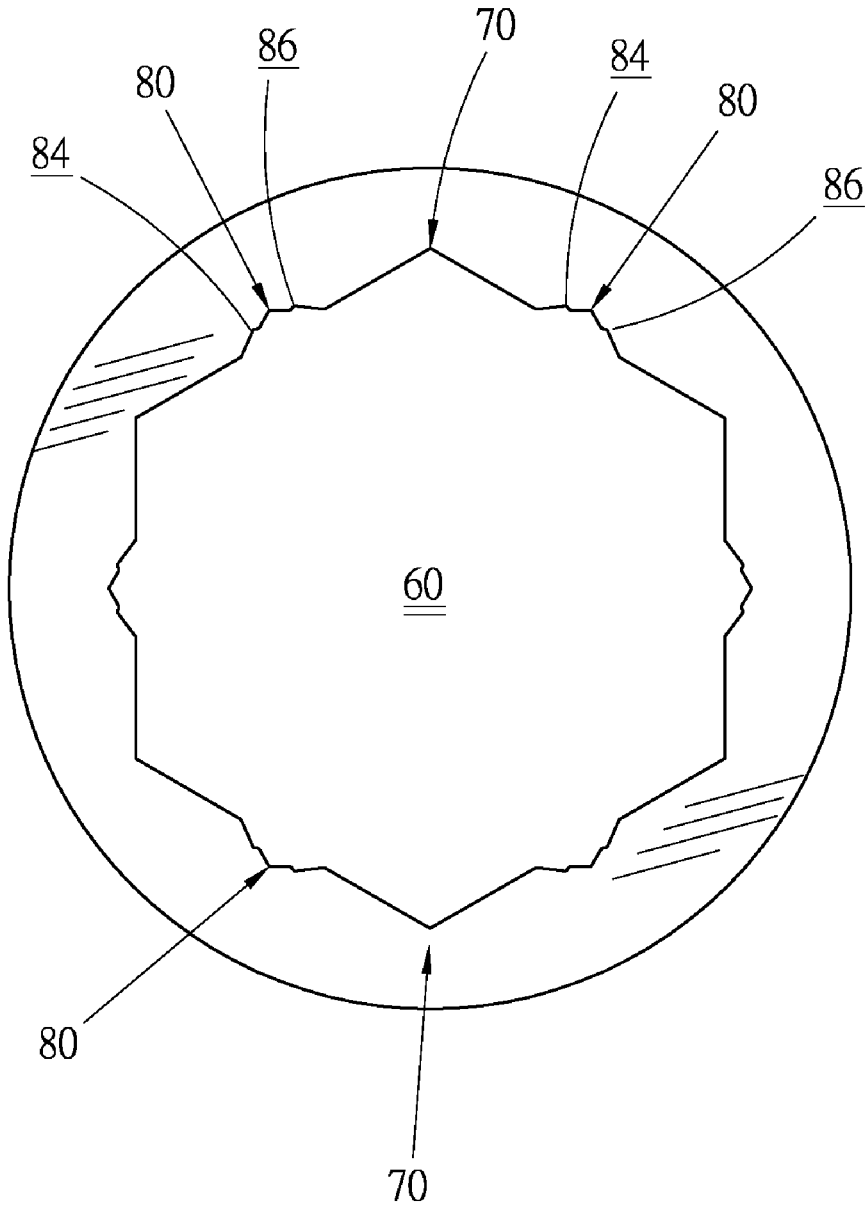
FIG. 12 is a top view of a third embodiment of the present invention.
Figure 13:
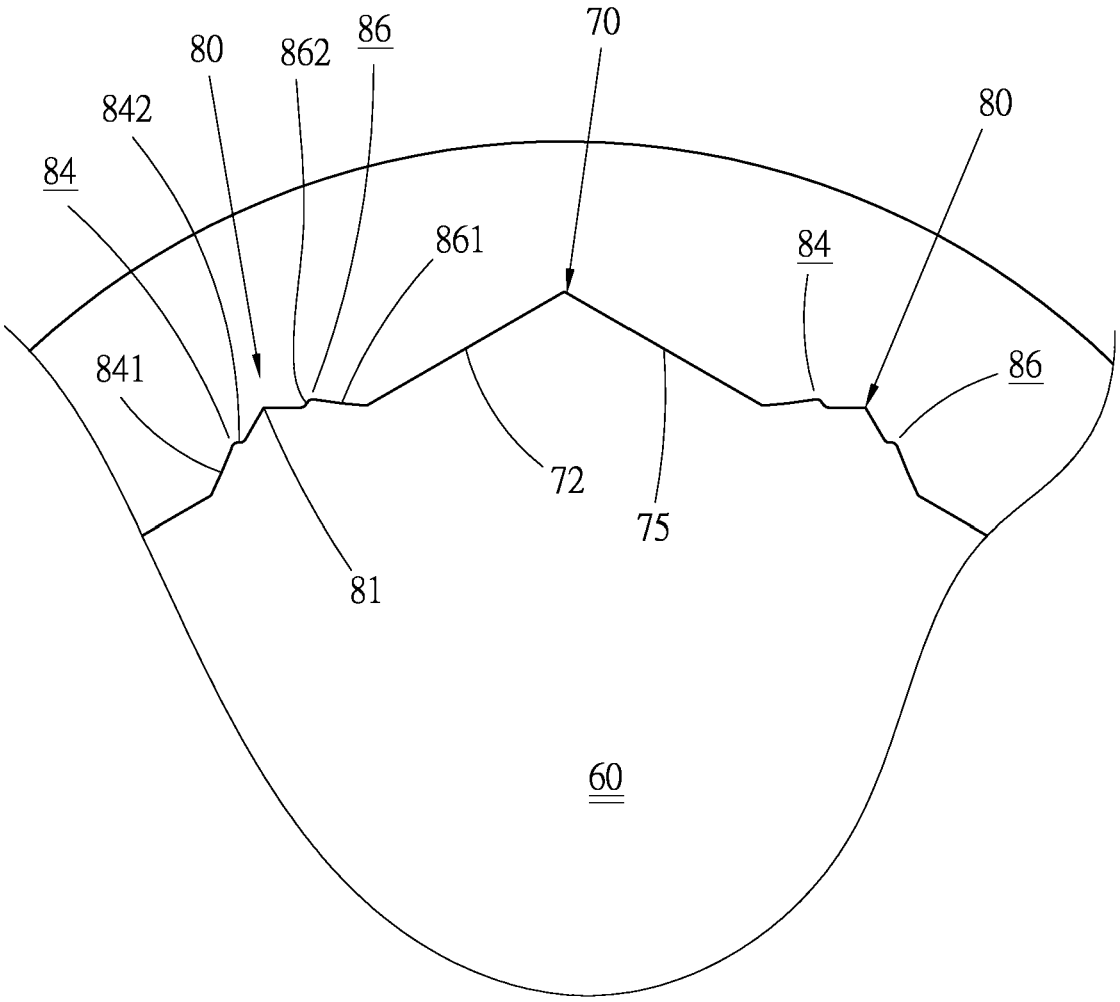
FIG. 13 is an enlarged view of a part of FIG. 12.

FIGS. 12 and 13 show a third embodiment of the wrenching tool of the present invention. In this embodiment, the second hexagonal hole of the fitting hole 60 has six second internal angles 80 each having a third side 82 such as the left side and a fourth side 85 such as the right side. Six third small internal angles 84 are respectively disposed on the third sides 82 of the second internal angles 80. Six fourth small internal angles 86 are respectively disposed on the fourth sides 85 of the second internal angles 80. Each third small internal angle 84 has a fifth small side 841 and a sixth small side 842. Preferably, the lengths of the fifth and sixth small sides 841, 842 are unequal to each other. Similarly, the lengths of the seventh and eighth small sides 861, 862 of the fourth small internal angle 86 are preferably unequal to each other. The distance that the third small internal angle 84 spaced from the tip 81 of the internal angle 80 and the distance that the fourth small internal angle 86 spaced from the tip 81 can be equal to or unequal to each other. Accordingly, the fitting hole 60 is applicable to at least three different sizes of threaded members.

It should be noted that small internal angles can be also respectively disposed on the first and second sides 72, 75 of the first internal angles 70 in addition to the small internal angles disposed on the third and fourth sides of the second internal angles 80. In this case, the fitting hole 60 is applicable to more different sizes of threaded members, for example, six sizes of the threaded members.

According to the aforesaid, the wrenching tool of the present invention provides other fitting positions in addition to the original fitting positions. Therefore, the wrenching tool has at least three fitting positions for fitting to more different sizes of threaded members to enhance utility efficiency. The present invention also helps in energy saving and carbon reduction. According to the present invention, it is unnecessary for a manufacturer to manufacture many different sizes of wrenching tools. Therefore, the manufacturing process such as electroplating is simplified to save resource and meet the requirements of environmental protection. With respect to a user, it is unnecessary to purchase many kinds of wrenching tools so that the cost is saved. In addition, the number of the tools carried by a user can be reduced to save strength and facilitate transfer.

The above embodiments are only used to illustrate the present invention, not intended to limit the scope thereof. Many modifications of the above embodiments can be made without departing from the spirit of the present invention.

What is claimed is:

1. A wrenching tool applicable to various sizes of threaded members, the wrenching tool comprising:

a body having a polygonal fitting hole formed of a first equilateral polygonal hole having multiple first internal angles and a second equilateral polygonal hole with the same configuration having multiple second internal angles, the two polygonal holes being concentrically arranged with an angular displacement to provide two fitting positions; the first polygonal hole of the fitting hole having a size larger than that of the second polygonal hole; the first internal angles each having a first side and a second side; and a first small internal angle of multiple first small internal angles is disposed on the first side of each the first internal angle, each first small internal angle of the multiple first small internal angles is spaced apart from opposing ends of the corresponding first side of each the first internal angle, the first small internal angles forming a third polygonal hole and providing another fitting position with a size smaller than that of the first polygonal hole;

wherein the first polygonal hole, the second polygonal hole and the third polygonal hole have an equal number of sides.

2. The wrenching tool as claimed in claim 1, wherein each the first small internal angle has two sides with different lengths, a long side of the first small internal angle being spaced from a tip of the first internal angle by a longer distance, while a short side of the first small internal angle being spaced from the tip of the first internal angle by a shorter distance.

3. The wrenching tool as claimed in claim 2, wherein the long side of the first small internal angle is a slope or an arced side.

4. The wrenching tool as claimed in claim 1, wherein a second small internal angle is disposed on the second side of each the first internal angle, the second small internal angles forming a fourth polygonal hole and providing another fitting position with a size smaller than that of the first polygonal hole, the first polygonal hole, the second polygonal hole the third polygonal hole and the fourth polygonal hole have an equal number of sides.

5. The wrenching tool as claimed in claim 4, wherein a distance between the tip of the first internal angle and the first small internal angle is equal to a distance between the tip of the first internal angle and the second small internal angle.

6. The wrenching tool as claimed in claim 4, wherein a distance between the tip of the first internal angle and the first small internal angle is unequal to a distance between the tip of the first internal angle and the second small internal angle.

7. The wrenching tool as claimed in claim 4, wherein each the second small internal angle has two sides with different lengths, a long side of the second small internal angle being spaced from a tip of the first internal angle by a longer distance, while a short side of the second small internal angle being spaced from the tip of the first internal angle by a shorter distance.

8. The wrenching tool as claimed in claim 1, wherein the second internal angles each having a first side and a second side; a third small internal angle being disposed on the first side of each the second internal angle, the third small internal angles forming a fourth polygonal hole and providing another fitting position, the first polygonal hole, the second polygonal hole the third polygonal hole and the fourth polygonal hole have an equal number of sides.

9. The wrenching tool as claimed in claim 8, wherein a fourth small internal angle is disposed on the second side of each the second internal angle, the fourth small internal angles providing another fitting position.

10. The wrenching tool as claimed in claim 1, wherein the first and second equilateral polygonal holes have metric system dimensions, while the fitting position provided by the first small internal angles has British system dimension or the first and second equilateral polygonal holes have British system dimensions, while the fitting position provided by the first small internal angles has metric system dimension.

11. A wrenching tool applicable to various sizes of threaded members, the wrenching tool comprising:

a body having a polygonal fitting hole formed of a first equilateral polygonal hole having multiple first internal angles and a second equilateral polygonal hole with the same configuration having multiple second internal angles, the two polygonal holes being concentrically arranged with an angular displacement to provide two fitting positions; the first polygonal hole of the fitting hole having a size larger than that of the second polygonal hole; the second internal angles each having a first side and a second side; and a first small internal angle of multiple first small internal angles is disposed on the first side of each the second internal angle, each first small internal angle of the multiple first small internal angles is spaced apart from opposing ends of the corresponding first side of each the second internal angle, first small internal angles forming a third polygonal hole and providing another fitting position with a size smaller than that of the second polygonal hole;

wherein the first polygonal hole, the second polygonal hole and the third polygonal hole have an equal number of sides.

12. The wrenching tool as claimed in claim 11, wherein each the first small internal angle has two sides with different lengths, a long side of the first small internal angle being spaced from a tip of the second internal angle by a longer distance, while a short side of the first small internal angle being spaced from the tip of the second internal angle by a shorter distance.

13. The wrenching tool as claimed in claim 12, wherein the long side of the first small internal angle is a slope or an arced side.

14. The wrenching tool as claimed in claim 11, wherein a second small internal angle is disposed on the second side of each the second internal angle, the second small internal angles forming a fourth polygonal hole and providing another fitting position with a size smaller than that of the second polygonal hole, the first polygonal hole, the second polygonal hole the third polygonal hole and the fourth polygonal hole have an equal number of sides.

15. The wrenching tool as claimed in claim 14, wherein a distance between the tip of the second internal angle and the first small internal angle is equal to a distance between the tip of the second internal angle and the second small internal angle.

16. The wrenching tool as claimed in claim 14, wherein a distance between the tip of the second internal angle and the first small internal angle is unequal to a distance between the tip of the second internal angle and the second small internal angle.

17. The wrenching tool as claimed in claim 14, wherein each the second small internal angle has two sides with different lengths, a long side of the second small internal angle being spaced from a tip of the second internal angle by a longer distance, while a short side of the second small internal angle being spaced from the tip of the second internal angle by a shorter distance.

18. The wrenching tool as claimed in claim 11, wherein the first and second equilateral polygonal holes have metric system dimensions, while the fitting position provided by the first small internal angles has British system dimension or the first and second equilateral polygonal holes have British system dimensions, while the fitting position provided by the first small internal angles has metric system dimension.

19. A wrenching tool applicable to various sizes of threaded members, the wrenching tool comprising:

a body having a polygonal fitting hole formed of a first equilateral polygonal hole and a second equilateral polygonal hole with the same configuration, the two polygonal holes being concentrically arranged with an angular displacement, the first equilateral polygonal hole providing a first fitting position, the second equilateral polygonal hole providing a second fitting position; the first polygonal hole having multiple first internal angles each having a first side and a second side; and a first small internal angle of multiple first small internal angles is disposed on the first side of each the first internal angle, each first small internal angle of the multiple first small internal angles is spaced apart from opposing ends of the corresponding first side of each the first internal angle, the first small internal angles forming a third polygonal hole and providing a third fitting position with a size smaller than that of the first fitting position;

wherein the first polygonal hole, the second polygonal hole and the third polygonal hole have an equal number of sides.

20. The wrenching tool as claimed in claim 19, wherein each the first small internal angle has two sides with different lengths, a long side of the first small internal angle being spaced from a tip of the first internal angle by a longer distance, while a short side of the first small internal angle being spaced from the tip of the first internal angle by a shorter distance.

21. The wrenching tool as claimed in claim 19, wherein the first and second equilateral polygonal holes have metric system dimensions, while the fitting position provided by the first small internal angles has British system dimension or the first and second equilateral polygonal holes have British system dimensions, while the fitting position provided by the first small internal angles has metric system dimension.

* * * * *